United States Patent [19]

Pretre

[11] Patent Number: 4,695,077

[45] Date of Patent: Sep. 22, 1987

[54] AUTOMOBILE INSURANCE CARD

[75] Inventor: Roger Pretre, Boulogne-Ballancourt, France

[73] Assignee: Moore Business Forms, Inc., Grand Island, N.Y.

[21] Appl. No.: 840,864

[22] Filed: Mar. 18, 1986

[30] Foreign Application Priority Data

Oct. 3, 1985 [FR] France ..... 85 14597

[51] Int. Cl.[4] ..... B42D 15/00; B42D 17/00; G09F 7/18

[52] U.S. Cl. ..... 283/81; 283/114; 110/594

[58] Field of Search ..... 283/81, 114; 156/52 A, 156/52 AL; 40/2 R, 594, 615; 428/40

[56] References Cited

U.S. PATENT DOCUMENTS

| | | | |
|---|---|---|---|
| 1,922,767 | 8/1933 | Humphner . | |
| 3,487,567 | 1/1970 | Waybright | 283/81 |
| 3,674,286 | 7/1972 | Dodgson . | |
| 3,924,879 | 12/1975 | Wright | 40/594 |
| 3,967,022 | 6/1976 | Hasei | 283/81 |
| 4,068,028 | 1/1978 | Samonides . | |
| 4,104,816 | 8/1978 | Pingeton | 40/594 |
| 4,159,586 | 7/1979 | Blum | 283/81 |
| 4,184,276 | 1/1980 | Hernandez . | |
| 4,204,706 | 5/1980 | Blum et al. . | |
| 4,211,021 | 7/1980 | Amprim et al. . | |
| 4,298,217 | 11/1981 | Moran et al. | 283/114 |
| 4,305,216 | 12/1981 | Skelton . | |
| 4,551,373 | 5/1985 | Conlon . | |

*Primary Examiner*—E. R. Kazenske
*Assistant Examiner*—Paul M. Heyrana
*Attorney, Agent, or Firm*—Cushman, Darby & Cushman

[57] ABSTRACT

A label showing insurance data or the like having a transparent film attached thereto by a first adhesive layer between the label and the film, and a second adhesive layer on the opposite side of the film for attaching the combined label and film to the inner surface of a glass pane of an automotive vehicle.

5 Claims, 5 Drawing Figures

Fig. 3
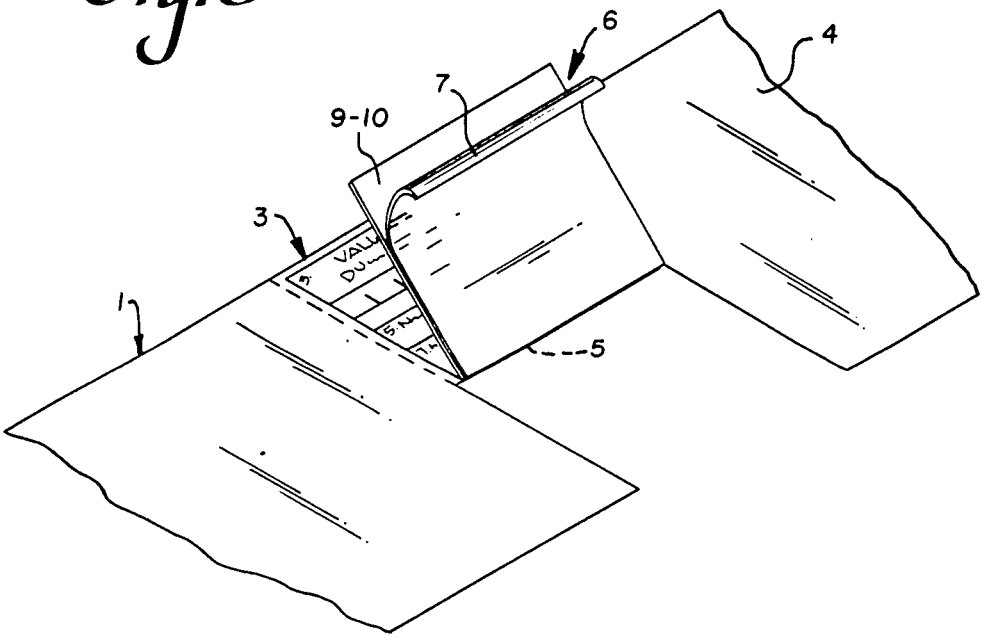
Fig. 4
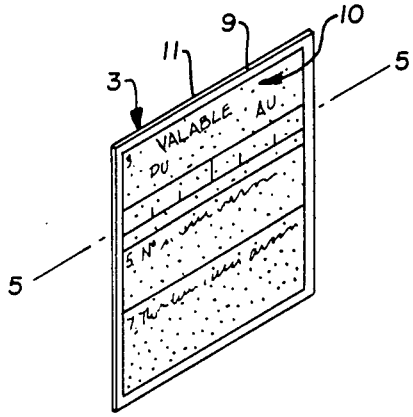
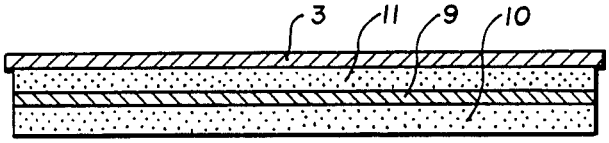
Fig. 5

AUTOMOBILE INSURANCE CARD

SUMMARY AND OBJECTS OF INVENTION

The present invention is related to labels which are to be adhered to a glass pane of a vehicle, more particularly on its wind-screen, for displaying data such as that evidencing the existence of insurance in force, the quality of a member with a contract of commutation in connection with a parking or garage, or other like indications.

A first object of the invention is a label ready to be adhered, which comprises a lower layer of paper or other material bearing the indications of identification of the insurance or commutation contract or other evidence, a superimposed, transparent film that adheres to said layer on one side and is provided on its external side with an adhesive layer for adhering the assembled label to a glass pane.

Another object of the invention is an insurance or commutation card which comprises a small block of flexible matter adhering thereto in register with a space or "field" having the same format that may be cut off and in which the data to be displayed are inscribed, said block including a transparent film provided with an adhesive on either side in such manner that with a protective cover removed the film may be allowed to adhere to said field, whereby the label ready for use is formed and may be separated from the card.

The following description with reference to the annexed drawings, given by way of non-limitative example, will describe how the invention can be implemented. The particulars that derive from the text as well as from the drawings are included within the scope of the invention.

Figure 1:
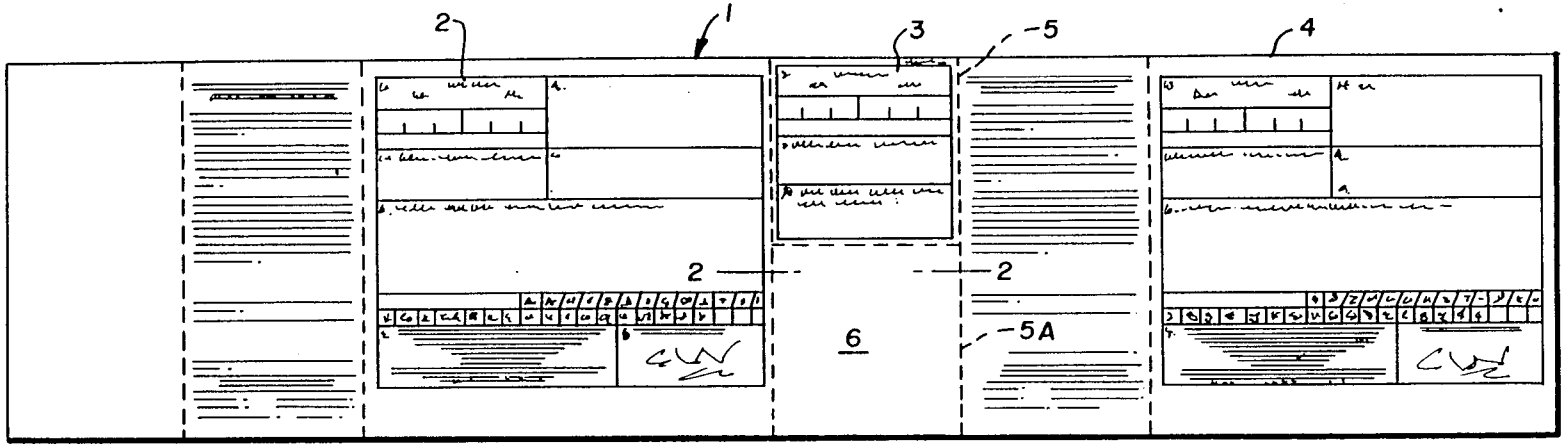
FIG. 1 shows an insurance card with the block according to the invention, which provides for the formation of the label.

FIG. shows, at a larger scale, a transverse cross-section of the block of FIG. 1 along line II—II;

FIG. 3 illustrates how the user is to fold the card for transferring the usable part of the block to the special corresponding field of the card;

FIG. 4 shows the label alone, and

FIG. 5 is a transverse cross-section of FIG. 4 at a larger scale.

DETAILED DESCRIPTION

In FIG. 1 an insurance card 1 for an automobile is shown. Card 1 includes as usual a number of such data as name and address of the insurant, the current number of the card and reference number of the insurance policy, the category and make of the vehicle, etc. A few essential particulars such as the validity term of the insurance and the registration number of the vehicle appear in field 2, while a symmetrical one is in field 3 on a flap 4 adjoined to the card when delivered to the insurant by the insurance company. This field 3 which will be used for forming the label is enclosed by a dotted line 5 for separating the field 3. The latter covers an upper region situated above an approximately mid-height line, beneath which a small block 6 of identical format adheres to the flap. Block 6 will be now described.

Figure 2:
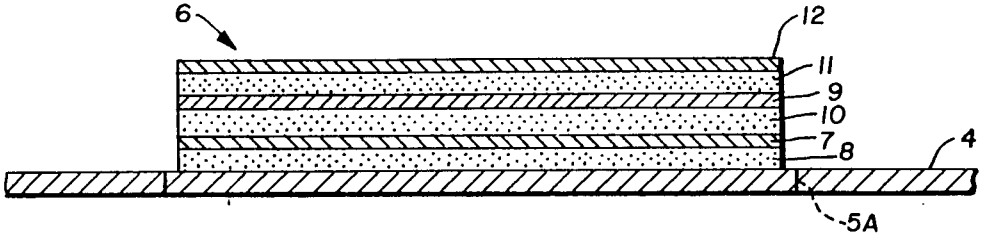

Block 6, seen in cross-section in FIG. 2, is made of a pile of flexible layers bound together by adhesive layers.

In the embodiment shown, a first layer 7 attached to flap 4 by an adhesive 8 is a protective sheet of paper. Over this sheet there is a transparent sheet 9 made of flexible plastic material coated with adhesives 10 and 11 on either side. The assembly is covered by a protective sheet of paper 12.

The card 1 thus fitted with the block 6 is sent to the insured party, who is capable, by simple manipulations, to form the label and thereafter cut it off from the card for sticking it to the windscreen of his vehicle.

The user first removes the protective sheet of paper 12 so as to expose the adhesive layer 11. Then he folds flap 4, or only the part of this flap that overlies block 6, after having cut it along the dotted line 5*a* so as to lay it down over field 3 of flap 4 (see folding step in FIG. 3). By means of adhesive 11 the transparent film 9 is thus applied and adhered to field 3. The user then removes the protective sheet of paper 7 so that the indications shown in field 3 may be seen through film 9. Finally, the user cuts off field 3 along the dotted line 5 to obtain the label which is ready to be adhered to the wind-screen by means of adhesive 10.

The adhesive used is of the "transfer" type which presently is well known in the art.

In a modification, the block including the transparent film and the upper protective cover could be directly adhered to the card field to be cut off immediately after printing the wanted data in this field. In this way it would suffice, in order to obtain the label ready for use, to remove the protective cover and thereafter separate the filled-in field with the film attached from the card.

The embodiments which have been described are only two possible embodiments and are given only for purposes of illustration. They could be modified inter alia by substitution of equivalent means without departing from the scope of the present invention. The true scope of the invention is to be determined from the appended claims.

What is claimed is:

1. A label mounting system for adhering an indicia-bearing label to a transparent support for viewing the indicia therethrough, said system comprising:

a substantially planar substrate having an indicia-receiving surface area and another surface area at least co-extensive in area with said first-mentioned area; and a label mounting stack supported upon and substantially overlying said second-mentioned area, said label mounting stack including a substantially transparent film releasably adhered on a first side thereof to said second-mentioned area and having a removable protective sheet releasably adhered to the other side thereof, whereby the protective sheet can be removed from the transparent film, the second-mentioned area placed over the first-mentioned area to adhere the other side of the transparent film over the first-mentioned area, and the substrate released from the first side of the transparent film so as to enable adhering the first side of the transparent film to a transparent support for viewing the first-mentioned area therethrough.

2. The label mounting system of claim 1, further comprising:

another protective sheet intermediate said transparent film and said second-mentioned area, said other protective sheet releasably adhered to said second-mentioned area and said transparent film releasably adhered to said other protective sheet.

3. The label mounting system of claim 1, wherein said first-mentioned area and said second-mentioned area are contiguous one another and separated by a fold line therebetween.

4. A label mounting system for adhering an indicia-bearing label to a transparent support for viewing the indicia therethrough, said system comprising:

a substantially planar substrate having an indica-receiving surface area and an adjacent surface area at least co-extensive in area with said first-mentioned area; and a label mounting stack supported upon and substantially overlying said second-mentioned area, said label mounting stack including a first adhesive layer on said second-mentioned area, a release sheet releasably adhered to said first adhesive layer, a second adhesive layer on said release sheet, a transparent film adhered on a first side thereof to said second adhesive layer, a third adhesive layer on the other side of said transparent film, and a second release layer releasably adhered to said third adhesive layer, whereby the second release sheet can be removed from the third adhesive layer, the substrate folded along a fold line between the first-mentioned and second-mentioned areas to adhere the third adhesive layer and the other side of the transparent film over the first-mentioned area, the substrate released from the first release sheet, and the first release sheet removed from the second adhesive layer so as to adhere the second adhesive layer to a transparent support for viewing the first-mentioned area therethrough.

5. A method of mounting an indicia-bearing label on a transparent support for viewing the indicia through the support, the method comprising the steps of:

providing an indicia-bearing surface area on a substrate;

forming a label mounting stack in a second surface area of the substrate, the label mounting stack having a surface area at least co-extensive with the indicia-bearing surface area, the label mounting stack including a substantially transparent film releasably adhered on a first side thereof to said second-mentioned area and having a removable protective sheet releasably adhered to the other side thereof;

removing the protective sheet from the other side of the transparent film;

folding the substrate along a fold line between the indicia-bearing surface area and the second-mentioned surface area to adhere the other side of the transparent film over the indicia-bearing area;

removing the substrate from the first side of the transparent film; and adhering the first side of the transparent film to a transparent support for viewing the first-mentioned area therethrough.

* * * * *